US005675100A

United States Patent [19]

Hewlett

[11] Patent Number: 5,675,100

[45] Date of Patent: Oct. 7, 1997

[54] METHOD FOR ENCODING MUSIC PRINTING INFORMATION IN A MIDI MESSAGE

[76] Inventor: Walter B. Hewlett, 945 Addison Ave., Palo Alto, Calif. 94301

[21] Appl. No.: 713,094

[22] Filed: Sep. 16, 1996

Related U.S. Application Data

[63] Continuation of Ser. No. 443,236, May 17, 1995, abandoned, which is a continuation of Ser. No. 146,750, Nov. 3, 1993, abandoned.

[51] Int. Cl.[6] ..... G10G 3/04; G10H 1/02

[52] U.S. Cl. ..... 84/462; 84/645; 84/658

[58] Field of Search ..... 84/453, 462, 477 R, 84/478, 615–620, 622–633, 645, 653–658, 662–665

[56] References Cited

U.S. PATENT DOCUMENTS

| | | | |
|---|---|---|---|
| 4,945,804 | 8/1990 | Farrand | 84/462 |
| 5,092,216 | 3/1992 | Wadhams | 84/462 X |
| 5,146,833 | 9/1992 | Lui | 84/462 |
| 5,202,526 | 4/1993 | Ohya | 84/462 |
| 5,208,421 | 5/1993 | Lisle et al. | 84/645 |

*Primary Examiner*—Stanley J. Witkowski

*Attorney, Agent, or Firm*—Adam H. Tachner; Crosby, Heafey, Roach & May; Rosenberg, Klein and Bilker

[57] ABSTRACT

A system and method of communicating music printing information using a minor enhancement to the conventional MIDI standard. This method degrades the communication of traditional MIDI command information or parameters by a small amount, but allows the inclusion of information important to music printing. MIDI compatible equipment that does not recognize the enhanced encoding can still utilize MIDI information that includes the enhanced encoding with minimal degradation of the performance information. In particular, the system method is useful for encoding enharmonic pitch encoding in the low order bits of MIDI note-on velocity information. The general method can be utilized to encode a wide variety of printing information in one or more selected MIDI control commands.

7 Claims, 4 Drawing Sheets

| −2 | −1 | NOTE | +1 | +2 |
|---|---|---|---|---|
| C−♭−♭ | C−♭ | C | C−♯ | C−♯−♯ |
| D−♭−♭ | D−♭ | D | D−♯ | D−♯−♯ |
| E−♭−♭ | E−♭ | E | E−♯ | E−♯−♯ |
| F−♭−♭ | F−♭ | F | F−♯ | F−♯−♯ |
| G−♭−♭ | G−♭ | G | G−♯ | G−♯−♯ |
| A−♭−♭ | A−♭ | A | A−♯ | A−♯−♯ |
| B−♭−♭ | B−♭ | B | B−♯ | B−♯−♯ |

FIG. 4

| | | | | | | |
|---|---|---|---|---|---|---|
| 1 | | /D♭♭ | /F♭♭ | /G♭ | /B♭♭ | 1 |
| 2 | 60 | −C | 63−E♭ | 66−F♯ | 69−A | 2 |
| 3 | | \B♯ | \D♯ | \E♯♯ | \G♯♯ | 3 |
| 1 | | /D♭ | /F♭♭ | /A♭♭ | /C♭♭ | 1 |
| 2 | 61 | −C♯ | 64−E | 67−G | 70−B♭ | 2 |
| 3 | | \B♯♯ | \D♯♯ | \F♯♯ | \A♯ | 3 |
| 1 | | /E♭♭ | /G♭♭ | /A♭ | /C♭ | 1 |
| 2 | 62 | −D | 65−F | 68−G♯ | 71−B | 2 |
| 3 | | \C♯♯ | \E♯ | \F♯♯♯ | \A♯♯ | 3 |

FIG. 5

| PITCH = | 60 | 61 | 62 | 63 | 64 | 65 | 66 | 67 | 68 | 69 | 70 | 71 |
|---|---|---|---|---|---|---|---|---|---|---|---|---|
| $v_{1,0}=0$ | – – – – – – PITCH – SPELLING – UNDETERMINED – – – – – – – – – | | | | | | | | | | | |
| $v_{1,0}=1$ | D♭♭ | D♭ | E♭♭ | F♭♭ | F♭ | G♭♭ | G♭ | A♭♭ | A♭ | B♭♭ | C♭♭ | C♭ |
| $v_{1,0}=2$ | C | C♯ | D | E♭ | E | F | F♯ | G | G♯ | A | B♭ | B |
| $v_{1,0}=3$ | B♯ | B♯♯ | C♯♯ | D♯ | D♯♯ | E♯ | E♯♯ | F♯♯ | F♯♯♯ | G♯♯ | A♯ | A♯♯ |

FIG. 6

| | | | | | | | | | | | | |
|---|---|---|---|---|---|---|---|---|---|---|---|---|
| $v_{1,0}=1$ | D♭♭ | D♭ | E♭♭ | F♭♭ | F♭ | G♭♭ | G♭ | A♭♭ | A♭ | B♭♭ | C♭♭ | C♭ |
| $v_{1,0}=2$ | C | (C♯) | (D) | E♭ | (E) | F | (F♯) | G | (G♯) | (A) | B♭ | (B) |
| $v_{1,0}=3$ | (B♯) | B♯♯ | C♯♯ | (D♯) | D♯♯ | (E♯) | E♯♯ | (F♯♯) | F♯♯♯ | G♯♯ | (A♯) | A♯♯ |

FIG. 7

| BINARY → / DECIMAL ↓ | x | 64 | 32 | 16 | 8 | 4 | 2 | 1 |
|---|---|---|---|---|---|---|---|---|
| 88 | | 1 | 0 | 1 | 1 | 0 | 0 | 0 |
| 89 | | 1 | 0 | 1 | 1 | 0 | 0 | 1 |
| 90 | | 1 | 0 | 1 | 1 | 0 | 1 | 0 |
| 91 | | 1 | 0 | 1 | 1 | 0 | 1 | 1 |
| 92 | | 1 | 0 | 1 | 1 | 1 | 0 | 0 |

FIG. 8

| | | | | | | | | | | | | |
|---|---|---|---|---|---|---|---|---|---|---|---|---|
| $v_{1,0} = 1$ | Dbb | Db | Ebb | Fbb | Fb | Gbb | Gb | Abb | Ab | Bbb | Cbb | Cb |
| $v_{1,0} = 2$ | (C) | (C#) | (D) | (Eb) | (E) | (F) | (F#) | (G) | (G#) | (A) | (Bb) | (B) |
| $v_{1,0} = 3$ | B# | B## | C## | D# | D## | E# | E## | F## | F### | G## | A# | A## |

FIG. 9

METHOD FOR ENCODING MUSIC PRINTING INFORMATION IN A MIDI MESSAGE

This is a continuation of application Ser. No. 08/443,236 filed on May 17, 1995, entitled "METHOD AND SYSTEM FOR ENCODING MUSIC PRINTING INFORMATION USING MIDI", now abandoned, which is a continuation of application Ser. No. 08/146,750 filed on Nov. 3, 1993, entitled METHOD AND SYSTEM FOR ENCODING MUSIC PRINTING INFORMATION USING MIDI, now abandoned.

FIELD OF THE INVENTION

This invention relates to a method and system of encoding one or more types of parametric information in conventional MIDI information. In particular, this invention relates to a method and system of encoding and using enharmonic pitch spelling information with a MIDI system.

BACKGROUND OF THE INVENTION

Common Musical Notation (CMN)

The modern system for notating the music of Western Civilization, referred to here as Common Musical Notation (CMN), has a long and distinguished history. The origins of the modern system can be traced as far back as the 10th Century AD with notation of early church chant. These simple melodies were made up entirely of the notes of what we today call the diatonic scale. This is the origin of the "white" keys on the modern keyboard. Early chant was not composed in what we today call the major-minor system of keys but rather in an older system call modes. All modes used the same diatonic scale tones, but each mode started at a different degree (note) of the diatonic scale. Thus, for example, the Dorian Mode started on what we today call the diatonic pitch of D and consisted of the notes, D, E, F, G, A, B, C. This mode sounds a lot like the modern key of D minor, but includes a "raised" sixth degree (the note B instead of the B♭ that would be called for in modern D minor.

The system for notating pitch in chants and other early music was quite simple. A set of lines was drawn (sometimes four, sometimes five, sometimes more than five), and the degrees of the scale were represented as positions on the lines or on the spaces in between them. This is the origin of our modem five-line staff system. In the case of the Dorian mode referred to above, the notation of the scale would look as shown in FIG. 1.

The important thing to notice is that each degree (note) of the scale has a position that is one level higher than the previous degree, but that the actual size of musical interval between two consecutive degrees is not the same in all cases. For example, the size of musical interval between D and E is what we today call a whole step. In terms of sound frequency, the pitch E is on the order of 12.24 percent higher than the pitch D (the actual size will depend on the system of tuning used). The size of the musical interval between E and F is what we today call a half step. In terms of sound frequency, the pitch F is on the order of 5.94 percent higher than the pitch E. To restate the point in another way, the levels on the musical staff do not all represent the same size musical interval.

The modern system of major-minor keys, which is the basis of practically all music written and/or performed today (both classical and popular), grew out of the earlier modal system. What allowed the major-minor system to develop was the ability to alter selectively the basic pitches of the modes either by raising them with what we today call a sharp (#), or lowering them with what we today call a flat (♭). The amount by which a pitch is raised or lowered by a sharp or a flat is a half-step, about 5.94 percent of the base (starting) frequency. The Dorian scale in the previous example can be made into a D-minor scale by flatting the B. In CMN the flat is put in front of the note making the scale shown in FIG. 2.

For the purpose of this discussion, it is important to note that raising the A in the example above with a sharp will produce a pitch (musical frequency) which is almost identical to the pitch (musical frequency) arrived at by lowering the next consecutive note B with a flat. In the even-tempered system of tuning, these frequencies are identical, but in a non-tempered system these frequencies are only close, not identical.

Tuning Systems and Modern Keyboard Instruments.

It is beyond the scope of this application to present a full explanation of the problem of tuning. Such a discussion would involve the theory of musical intervals and their relationship to musical harmonics. Suffice it to say that over the course of the development of Western music (principally the 14th through the end of the 17th centuries), several systems of tuning were devised and used. With the advent of the modern major-minor system of scales and keys toward the very end of the 17th century, the need developed for a tuning system in which the size of any particular musical interval would be the same (in terms of the ratio of sound frequencies) for all musical scales and keys. The system which does this is called the Even-Tempered System of tuning. In this system, all half-steps are the same size, and there are twelve of them in an octave. Since an octave is the interval between two pitches whose ratio is 2 to 1, the size of the half-step interval in the Even-Tempered System is the twelfth root of two, or approximately 1.059463 to 1.

With the acceptance of the Even-Tempered System, it became possible to standardize, once and for all, the configuration of the keyboard (piano, clavichord, harpsichord, organ). This configuration, with accidentals (i.e., modifications to the principal degrees, e.g. C#, D#, F#, G#, and A#) being represented by shorter, thinner keys (the "black" keys) placed between wider, longer keys (the "whim" keys), had already developed over the course of the previous 5 centuries as the primary layout of the musical keyboard. In this configuration, there is only one key (a "black" key) for the musical pitches notated as C-# and D-♭; and in the Even-Tempered System of tuning, these musical pitches have the same frequency. Likewise with the other "black" keys of the keyboard: i.e., D-#=E-♭; F-#=G-♭; G-#=A-♭; and A-#=B-♭. This "alternate spelling" of frequency-equivalent pitches is not limited to the black keys of the keyboard. There are, in fact, an infinite number of pitch spellings for each pitch as defined by musical frequency. The note A4, which in modern American tuning is the pitch of 440 Hertz (444 in Europe), can alternatively be spelled F4-#-#-♮-♮, G4-♮-♮, A4, B4-♭-♭, C5-♭-♭-♭, D5-♭-♭-♭-♭-♭. In "real-life" situations, it is rare to find more than two sharps or flats attached to a primary degree (note letter).

MIDI representation of pitch.

The Musical Instrument Digital Interface (MIDI) standard for representing musical events developed originally as a convention for communicating between electronic instruments. Since the primary (and musically most sophisticated) electronic instrument was the music (piano) keyboard, a system was devised to represent all possible (musically "likely") keys on the keyboard. The note, middle C, normally designated C4, was assigned the number 60. Each successive key above C4 was assigned a successively higher integer, and each successively lower key was assigned a successively lower integer. This system has served its original purpose well, since each note (key) on the keyboard has one and only one number associated with it.

The Problem with MIDI and the printing of music

The MIDI Interface

The MIDI system is well known. A wide variety of instruments and MIDI-compatible devices have been patented. For a good general background on the MIDI system, see U.S. Pat. No. 5,208,421 by Lisle et al, a portion of which is reproduced here.

MIDI was established as a hardware and software specification which would make it possible to exchange information such as: musical notes, program changes, expression control, etc. between different musical instruments or other devices such as: sequencers, computers, lighting controllers, mixers, etc. This ability to transmit and receive data was originally conceived for live performances, although subsequent developments have had enormous impact in recording studios, audio and video production, and composition environments.

A standard for the MIDI interface has been prepared and published as a joint effort between the MIDI Manufacturer's Association (MMA) and the Japan MIDI Standards Committee (JMSC). This standard is subject to change by agreement between JMSC and MMA and is currently published as the MIDI 1.0 Detailed Specification, Document Version 4.1, January 1989. Various revisions and extensions of this system have been described in the literature but the basic standard is still followed.

The hardware portion of the MIDI interface operates at 31.25 KBaud, asynchronous, with a start bit, eight data bits and a stop bit. This makes a total of ten bits for a period of 320 microseconds per serial byte. The start bit is a logical zero and the stop bit is a logical one. Bytes are transmitted by sending the least significant bit (LSB) first. Data bits are transmitted in the MIDI interface by utilizing a five milliamp current loop. A logical zero is represented by the current being turned off. Rise times and fall times for this current loop shall be less than two microseconds. A five pin DIN connector is utilized to provide a connection for this current loop with only two pins being utilized to transmit the current loop signal. Typically, an opto-isolator is utilized to provide isolation between devices which are coupled together utilizing a MIDI format.

Communication utilizing the MIDI interface is achieved through multi-byte "messages" which consist of one status byte followed by one or two data bytes. There are certain exceptions to this role. MIDI messages are sent over any one of sixteen channels which may be utilized for a variety of performance information. There are five major types of MIDI messages: Channel Voice; Channel Mode; System Common; System Real-Time; and System Exclusive. A MIDI event is transmitted as a message and consists of one or more bytes.

A channel message in the MIDI system utilizes four bits in the status byte to address the message to one of sixteen MIDI channels and four bits to define the message. Channel messages are thereby intended for the receivers in a system whose channel number matches the channel number encoded in the status byte. An instrument may receive a MIDI message on more than one channel. The channel in which it receives its main instructions, such as which program number to be on and what mode to be in, is often referred to as its "Basic Channel." There are two basic types of channel messages, a Voice message and a Mode message. A Voice message is utilized to control an instrument's voices and Voice messages are typically sent over voice channels. A Mode message is utilized to define the instrument's response to Voice messages. Mode messages are generally sent over the instrument's Basic Channel.

A variety of Channel Messages are among the most-frequently used signals in a typical MIDI system. These signals include "note on", "now off", pitch, and velocity (how hard a particular note is struck or plucked). These signals are utilized for transmission of almost every note of a performance. "After touch" may be used with every note in some circumstances and never used in other circumstances. Other signals may be used more or less frequently, depending on the nature of the instrumentation and performance. General loudness settings (piano, mezzoforte, etc.) and voice changes are sent as needed. Pitch bend or modulation commands may be sent occasionally, phrase-by-phrase or note-by-note as called for in a specific performance, transcription or sequence.

System messages within the MIDI system may include Common messages, Real-Time messages, and Exclusive messages. Common messages are intended for all receivers in a system regardless of the channel that receiver is associated with. Real-Time messages are utilized for synchronization and are intended for all clock based units in a system. Real-Time messages contain status bytes only, and do not include data bytes. Real-Time messages may be sent at any time, even between bytes of a message which has a different status. Exclusive messages may contain any number of data bytes and can be terminated either by an end of exclusive or any other status byte, with the exception of Real-Time messages. An end of exclusive should always be sent at the end of a system exclusive message. System exclusive messages always include a manufacturer's identification code. If a receiver does not recognize the identification code it will ignore the following dam.

As those skilled in the art will appreciate upon reference to the foregoing, musical compositions may be encoded utilizing the MIDI standard and stored and/or transmitted utilizing substantially less than data than would otherwise be required. The MIDI standard permits the transmittal of a serial listing of program status messages and channel messages, such as "note on" and "note off" and as a consequence require substantially less digital data to encode than the straightforward digitization of an analog musical signal. Using the MIDI system provides additional advantages including the ability to transmit the MIDI signals to a variety of MIDI-compatible devices to allow simultaneous translation of a single signal for multiple purposes and also to allow mixing signals to a variety of devices on a single signalling connection.

Extensions to MIDI

The MIDI standard was originally designed for communication between electronic instruments. About the time it was being developed, however, it was also becoming clear to many people that not only could one musical instrument be used to control another, but musical instruments themselves could be controlled by computer. Put another way, a sequence of electronic (MIDI) commands that might be generated (in a performance) on a musical keyboard could also be generated by computer. The receiving instrument has no way to know what the origin of the commands is (computer vs. live performance). In a similar manner, the "sending" instrument knows nothing about the nature of the "receiving" instrument under the MIDI standard. It is therefore possible for the receiving instrument to be a computer, which is actually recording (receiving and storing) the MIDI signals from the sender. In this way, a musical performance (defined as a series of physical gestures on an electronic keyboard), can be recorded (received and stored) on a computer and later played back on (sent to) the same keyboard or some other sound generating device which "understands" MIDI commands.

With the advent of "MIDI" recordings and simulated recordings compiled by software, the need arose to find a way to pass this data from one computer to another. Also there were several descriptive aspects of the music not originally representable by the initial MIDI standard which people wanted to include in their files. Among these aspects are the key of the piece (number of sharps and flats), the mode (major or minor), the time signature, the tempo, musical lyrics, and other attributes. An extension of the original MIDI standard was developed for passing this information.

MIDI and the spelling of musical pitches

There is, however, one aspect of the music which has not been addressed by and is not included in this standard, and for a very good reason. This aspect is the spelling of the musical pitches. This information: (1) does not come from a live performance, since the configuration of the musical keyboard does not distinguish between the spelling of pitches (e.g. C-# and D-♭ are the same key); and (2) is irrelevant in a playback performance (e.g. an instruction to play a C-# or an instruction to play a D-♭ would be "routed" to the same pitch on a standard MIDI playback device).

Aside from the fact that pitch spelling is neither "representable" on an electronic keyboard nor relevant to a MIDI playback, there is a technical reason why the framers of the extended MIDI standard did not include this attribute in their specifications. This information preferably should accompany every note that is struck, and the basic MIDI standard for representing "note events" does not allow space for communicating this information. At a minimum, this information should accompany any note which might have ambiguous spelling, particularly if the spelling is inconsistent with the general harmonic structure of the current key signature.

In particular, a note event in the conventional MDI encoding consists of four parts: (1) a time interval; (2) a command; (3) a pitch; and (4) a velocity. Under certain circumstances, the second part a (command) may be omitted. All of the other parts generally are necessary to properly communicate a note event. Referring to FIG. 3, a "note-on" event includes a channel identification (9), a command (turn note on) (9), a pitch (kk), and a velocity (vv). A note event may also include certain optional parts, such as after-touch and pitch-bend.

Each of the note-event parts command, the pitch and the velocity occupy one byte. By convention, each pitch and velocity byte must have its high order (most significant) bit be zero. This limits the range of these attributes to 128 values, i.e., 0 to 127.

The spelling of musical pitches in the printing of music

Although the spelling of a musical pitch generally is irrelevant to an electronic performance, it can be quite important to music printing. A piece of music printed with incorrect spellings is difficult for a musician to read correctly, and can be virtually unreadable in some cases (at least as far as performance of the music is concerned). Under the current MIDI standard it is not possible to include the information necessary for the proper printing of the music represented. The MIDI standard has become a de-facto method of exchanging musical data; yet no practical method has been devised for communicating the proper spelling of musical pitches, and this limitation has severely limited use of MIDI as far as software for printing music is concerned. Current printing software must make a "guess" about the correct spelling. Experience with entering over 1000 movements of music from the 17th through the 19th centuries shows that while such guessing can produce the correct spelling much of the time, there is still the need for a skilled musician to proof-read the printed output, a tedious and time-consuming process, which itself can never be guaranteed to be error free.

Using MIDI data for music printing

There are several commercially available software programs for printing music which accept MIDI data as a form of input. Each program converts the MIDI data to its own internal format, making guesses in the process about what the correct spelling should be. The notes cannot be printed without making these guesses. For example, the MIDI pitch 61, one half-step above middle C (C4), can be the note C4# or the note D4♭. The first of these is printed on a line and the second is printed in a space between lines, each with an independent modifier.

Each program typically produces output in three ways: as musical characters and signs (1) displayed on a CRT screen or flat-panel screen or (2) printed on a page (usually via a laser printer connected to a host computer); and (3) as a file which can be transferred to another hardware device for printing. The display and printing of music cannot be done without hardware, and indeed, the control of that hardware is an important function of the music printing software referred to above.

The Center for Computer Assisted Research in the Humanities is engaged in the compilation of full-text musical databases for general distribution. The primary means of distribution for this data will be the MIDI format. A major application for this data is music printing. The inclusion of pitch spelling information in the two low-order bits of the note-on velocity byte is outside of (has nothing to do with) the MIDI standard, and will be ignored by commercial programs which interpret this data in the standard way. Yet this "hidden" information can be of great value to software programs which know about it and whose purpose is the reconstruction, display and printing of the original music. We regard the inclusion of this information in our data files be an integral part of the process of reconstruction, display and printing of the original music.

SUMMARY OF THE INVENTION

The present invention discloses a system and method of communicating music printing information using a minor enhancement to the conventional MIDI standard. This method degrades the communication of traditional MIDI command information or parameters by a small amount, but allows the inclusion of information important to music printing. MIDI compatible equipment that does not recognize the enhanced encoding can still utilize MIDI information that includes the enhanced encoding with minimal degradation of the performance information.

In particular, the present invention is useful for encoding enharmonic pitch encoding in the low order bits of MIDI note-on velocity information. The general method can be utilized to encode a wide variety of printing information in one or more selected MIDI control commands.

BRIEF DESCRIPTION OF THE DRAWINGS

FIG. 4 illustrates pitch spellings for a C-Major scale, together with the notes one and two half-steps above and below each note of the scale.

FIG. 5 illustrates the 12 half-steps of a representative octave together with enharmonic pitch spellings based on flatting the half-step above and sharping the half-note below each reference note.

FIG. 6 illustrates the same spellings shown in FIG. 5 together with a preferred value for $v_{1,0}$ for the least significant velocity bits to encode a specific enharmonic coding for each note.

FIG. 7 illustrates the same information in FIG. 6 but underlines the notes of the diatonic scale in the key of E-Major.

FIG. 8 illustrates a table of selected binary equivalents showing how modifying the two low-order bits of the velocity parameter makes only a small change in the perceived volume of an enharmonically encoded note.

FIG. 9 illustrates the same information in FIG. 6 but underlines the notes of the diatonic scale in the key of F-Major.

DESCRIPTION OF THE PREFERRED EMBODIMENTS

Background of the Method

For most musical applications today, it is sufficient to represent pitch spellings which fall in the range of two flats to two sharps (thirty-five in all). In any particular octave, these are as shown in FIG. 4.

| | | | | |
|---|---|---|---|---|
| C♯♯ | C♯ | C | C♭ | C♭♭ |
| D♯♯ | D♯ | D | D♭ | D♭♭ |
| E♯♯ | E♯ | E | E♭ | E♭♭ |
| F♯♯ | F♯ | F | F♭ | F♭♭ |
| G♯♯ | G♯ | G | G♭ | G♭♭ |
| A♯♯ | A♯ | A | A♭ | A♭♭ |
| B♯♯ | B♯ | B | B♭ | B♭♭ |

For any note represented by a MIDI number, there are three possible pitch spellings within the range of two flats to two sharps. These are listed in FIG. 5 for octave range 60=C4 (middle C) to 71=B4:

| | | | | | |
|---|---|---|---|---|---|
| 1 | /D♭♭ | /F♭♭ | /G♭ | /B♭♭ | 1 |
| 2 | 60 -C | 63-E♭ | 66-F♯ | 69-A | 2 |
| 3 | \B♯ | \D♯ | \E♯♯ | \G♯♯ | 3 |
| 1 | /D♭ | /F♭♭ | /A♭♭ | /C♭♭ | 1 |
| 2 | 61 -C♯ | 64-E | 67-G | 70-B♭ | 2 |
| 3 | \B♯♯ | \D♯♯ | \F♯♯ | \A♯ | 3 |
| 1 | /E♭♭ | /G♭♭ | /A♭ | /C♭ | 1 |
| 2 | 62 -D | 65-F | 68-G♯ | 71-B | 2 |
| 3 | \C♯♯ | \E♯ | \F♯♯♯ | \A♯♯ | 3 |

Enharmonic Spelling Encoding

Several MIDI commands give more information than is required for a typical performance and it is possible to reassign some normal MIDI information for new purposes. Methods of modifying MIDI information are well known in the art. Briefly, the method follows the sequence:

input MIDI command containing selected parameter, identify bit(s) to be modified, modify bits according to desired encoding, export modified MIDI command.

This can be used as a subroutine in virtually any music program utilizing MIDI commands.

Figure 1:
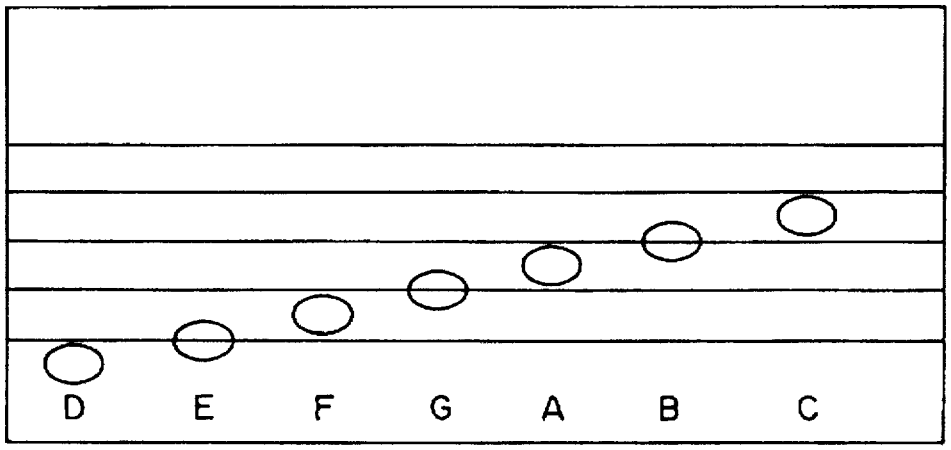
FIG. 1 illustrates a diatonic, whole note scale in Dorian mode.
Figure 2:
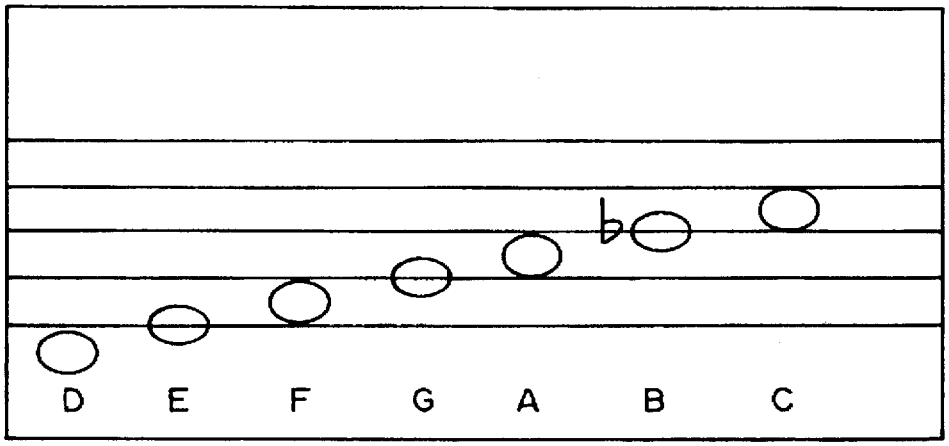
FIG. 2 illustrates a diatonic, whole note D-minor scale.
Figure 3:
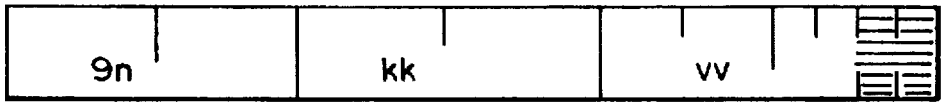
FIG. 3 illustrates MIDI encoding of a typical note-on command, where n is the MIDI Channel number (0-F), kk is the key number (00-7F), and vv is the velocity (01-7F) showing the lowest significant bits which are modified according the method of the invention.

In particular, the velocity parameter, which can vary from 0 to 127 is, in general, more sensitive than is really needed. The velocity parameter communicates the speed with which a key is pressed down, and this, in turn communicates information about the attack as well as the volume (loudness) of the note in question. The velocity parameter is defined in MIDI as an 8 bit value (128 distinct values). This value is normally sent as the last portion of a note-on or a note-off command. See FIG. 3. In written music, velocity (loudness) is normally differentiated into only 6 levels—*ff*, *f*, m*f*, mp, p and pp—but in some instances an additional 4 levels are used—*ffff*, *fff*, ppp and pppp.

The new method and system uses the two low-order bits of this parameter to convey pitch spelling. This leaves six bits to encode true velocity, which means that encoded velocity can only take on 32 different values compared to 128 possible values in unencoded velocity. Only a very subtle performance needs to discriminate 128 velocity levels and for most applications 32 levels is sufficient.

If $v_{1,0}$ is the value of the two low-order bits of the velocity parameter, $v_{1,0}$ can take on the decimal values 0, 1, 2, or 3 (binary values 00, 01, 10 or 11). The table in FIG. 6 shows how this can be used to represent pitch spelling:

| pitch = | 60 | 61 | 62 | 63 | 64 | 65 | 66 | 67 | 68 | 69 | 70 | 71 |
|---|---|---|---|---|---|---|---|---|---|---|---|---|
| $v_{1,0}$ = 0 | pitch - spelling - undetermined | | | | | | | | | | | |
| $v_{1,0}$ = 1 | D♭♭ | D♭ | B♭♭ | F♭♭ | F♭ | G♭♭ | G♭ | A♭♭ | A♭ | B♭♭ | C♭♭ | C♭ |
| $v_{1,0}$ = 2 | C | C♯ | D | E♭ | E | F | F♯ | G | G♯ | A | B♭ | B |
| $v_{1,0}$ = 3 | B♯ | B♯♯ | C♯♯ | D♯ | D♯♯ | E♯ | E♯♯ | F♯♯ | F♯♯♯ | G♯♯ | A♯ | A♯♯ |

An advantage of this system is that the variation in the velocity parameter caused by specification of spelling is, in fact, minimal for any particular key. This is because most music in a key is notated in a consistent way. Consider, for example, the key of E, with four sharps. The table of FIG. 6 shows the pitch spellings usually found in this key, with the most common ones shown in parentheses and the next most common shown in underline.

| | | | | | | | | | | | | |
|---|---|---|---|---|---|---|---|---|---|---|---|---|
| $v_{1,0}=1$ | D𝄪 | D♭ | E𝄫 | F𝄫 | F♭ | G𝄫 | G♭ | A𝄫 | A♭ | B𝄫 | C𝄫 | C♭ |
| $v_{1,0}=2$ | C | (C♯) | (D) | e♭ | (E) | F | (F♯) | G | (G♯) | (A) | B♭ | (B) |
| $v_{1,0}=3$ | (B♯) | B♯♯ | C♯♯ | (D♯) | D♯♯ | (E♯) | E♯♯ | (F♯♯) | F♯♯♯ | G♯♯ | (A♯) | A♯♯ |

As can be seen, all of these pitches have $v_{1,0}=2$ or $v_{1,0}=3$. This means that a selected input velocity will be increased by 2 or by 3 units to encode the most common spellings. For example, an input velocity of 90 (=binary 1011010) would be encoded as 90 and 91 virtually all of the time. See the table of selected binary equivalents in FIG. 8. Most musicians can at best barely hear the difference between a velocity of 90 and a velocity of 91.

| Binary → Decimal ↓ | x | 64 | 32 | 16 | 8 | 4 | 2 | 1 |
|---|---|---|---|---|---|---|---|---|
| 88 | | 1 | 0 | 1 | 1 | 0 | 0 | 0 |
| 89 | | 1 | 0 | 1 | 1 | 0 | 0 | 1 |
| 90 | | 1 | 0 | 1 | 1 | 0 | 1 | 0 |
| 92 | | 1 | 0 | 1 | 1 | 0 | 1 | 1 |
| 92 | | 1 | 0 | 1 | 1 | 1 | 0 | 0 |

Consider a second, more challenging case, namely the key of F (one flat). See FIG. 9.

| | | | | | | | | | | | | |
|---|---|---|---|---|---|---|---|---|---|---|---|---|
| $v_{1,0}=1$ | D𝄪 | D♭ | E𝄫 | F𝄫 | F♭ | G𝄫 | G♭ | A𝄫 | A♭ | B𝄫 | C𝄫 | C♭ |
| $v_{1,0}=2$ | (C) | (C♯) | (D) | (E♭) | (E) | (F) | (F♯) | (G) | (G♯) | (A) | (B♭) | (B) |
| $v_{1,0}=3$ | B♯ | B♯♯ | C♯♯ | D♯ | D♯♯ | E♯ | E♯♯ | F♯♯ | F♯♯♯ | G♯♯ | A♯ | A♯♯ |

In this key, the most common notes are distributed between all three rows, but, significantly, all of the most common spellings (in parentheses) are in the $v_{1,0}=2$ row. This means that 99 percent of the notes would have the same value. In the case above with an input velocity of 90, almost all of the velocities would be 90, with a few 89's and a few 91's. Most listeners would not notice the difference.

System Performance

The method described above may degrade somewhat the representation of a musical performance. While it is true that a listener would have trouble distinguishing between velocities of 90 and 91, in the case of especially low velocities (soft notes), say for example numbers below 20, it is possible to hear the difference between consecutive numbers. Even more important, if someone wanted to represent a gradual crescendo or decrescendo, they would not have access to the minute gradations in velocity provided by the MIDI standard. For the note C4, for example, they could not increase velocity in this manner: 2, 3, 4, 5, 6, 7, 8, 9, 10, etc., but would be required to increase it by increments of 4, i.e., 2, 6, 10, etc.

There is a vast market for the transmission and distribution of traditionally-notated music data via the MIDI standard. This music data is typically not generated by a performance, but rather is compiled via data entry and software from musical scores. The information about dynamics in these scores is sketchy and very much open to interpretation. The user is therefore not particularly interested in this information (as communicated in the velocity parameter), since he/she will probably be using his/her software to modify these parameters in performance. The inclusion of pitch spelling information in these music files via the low order bits of the velocity parameter provides the user with valuable information on music printing while in no way disrupting the established MIDI standard.

Software that is aware of the presence of encoded information can easily make use of it, while at the same time software that is not aware of the presence of encoded information can function in the traditional manner without modification and with little or no resultant effect.

It should be pointed out that the velocity parameter applies to both note-on and note-off events. Pitch spelling information need only be attached (and should only be attached) to note-on events. (MIDI 9× commands). The reason is that the need to know pitch spelling comes at the time a note is turned on, not off; and it can happen that a note is turned on several times and subsequently turned off the same number of times. In this case, there is no way to connect each note-off event with a specific note-on event, so representing pitch spelling in note off-events might lead to confusing or erroneous results.

It is desirable that software reading MIDI files with pitch spelling information know that this information is, in fact, present. This fact can be communicated in a member of ways. In a preferred embodiment, the presence of encoding information is communicated via the format word (16 bits) of the Header Chunk of the MIDI file. The MIDI specification specifies this word for general communication and initiation purposes.

Altogether, there are 13 bits available in the velocity parameter; 6 in the note-on event, and 7 in the note-off event. One bit in the note-on event is needed to indicate that the note, indeed, is to be mined on. In a preferred embodiment, two of these bits (the low order two bits of the velocity byte of the note-on event) are used to represent pitch spelling. One skilled in the art will recognize that other bits could be used for this same purpose.

The method and system of this invention can be used to encode other information within "traditional" MIDI information. One such class of information is enharmonic spelling, described in detail above. Another class of information regards the beginning and ending of slurs. Musical slurs are an indispensable part of music printing; yet the current MIDI specification provides no means to represent them. In traditional Western music, it is extremely uncommon to require more than 3 slurs to be operable at one time in one part. Therefore, it requires only the use of 4 bits of available MIDI information to represent slur-on and slur off information. In one preferred implementation, this information is encoded in bits 2–5 of the velocity parameter (the next four least significant bits above the encoded enharmonic spelling). This encoding can be done in the following way:

| Value of the bits | Meaning |
|---|---|
| 0000 | No slur information attached to this note |
| 0001 | Start slur "A" on this note |
| 0010 | Start slur "B" on this note |
| 0011 | Start slur "C" on this note |
| 0100 | Stop slur "A" on this note |
| 0101 | Stop slur "A" and re-start slur "A" on this note |

-continued

| Value of the bits | Meaning |
|---|---|
| 0110 | Stop slur "A" and start slur "B" on this note |
| 0111 | Stop slur "A" and start slur "C" on this note |
| 1000 | Stop slur "B" on this note |
| 1001 | Stop slur "B" and start slur "A" on this note |
| 1010 | Stop slur "B" and re-start slur "B" on this note |
| 1011 | Stop slur "B" and start slur "C" on this note |
| 1100 | Stop slur "C" on this note |
| 1101 | Stop slur "C" and start slur "A" on this note |
| 1110 | Stop slur "C" and start slur "B" on this note |
| 1111 | Stop slur "C" and re-start slur "C" on this note |

"A", "B", and "C" can be assigned as needed to slurs as they occur. If more than three slurs are active at one time (unusual case) the excess over three would be ignored.

Various types of MIDI information can be used for encoding desired information. While it is less easy to use the velocity byte of a note-off event to provide specific information about a specific note, this byte is ideal for setting general flags in the context of music printing. One possible use might be to signal stem directions, i.e., all notes after this point in the file (or in this voice) have stem up, or all notes after this point in the file (or in this voice) have stem down. Mother use could be to signal to software how to make guesses about pitch spelling, assuming the exact spelling was not provided in the note-on velocity byte. Such a method would be less intrusive on the MIDI standard, since the note-off velocity byte is basically ignored by all applications; but it would require a tighter coupling between the data and the printing software, since the "guessing" algorithm would have to be uniquely specified.

This new system of encoding can utilize and modify any of several MIDI instructions. In general, there are two classes of instructions which are useful in practicing this invention, note-specific and channel (note-independent).

The enharmonic spelling encoding scheme of this invention is described above as using the two least significant bits of the Note-On velocity parameter. However, the MIDI standard includes a number of messages which can be modified to provide encoding for a variety of music printing commands and parameters.

Another useful note-specific MIDI message is "Polyphonic Key Pressure." This message contains a MIDI channel number (0–15), the key number (0–127), and a pressure value that corresponds to the amount of force applied to the key (0–127). The "Note Off" message is generated every time a key is released on a MIDI keyboard. This message contains the MIDI channel number (0–15), the key number (0–127), and a velocity value (0–127). For suitably equipped keyboards, the velocity value reflects the speed with which a key is released. If no dynamic is measured, the velocity value is set to zero. A "Note On" message is equivalent in structure. For the reasons discussed above, the "Note On" message is most helpful for encoding and harmonic spelling of a note, since the selection of correct enharmonic spelling is preferably determined when the note is initiated. This allows that specific note to be spelled correctly when it is printed. Various other types of information, however, can be encoded or decoded with less time specificity or precision and still give acceptable printing information without noticeably degrading a performance using the encoded information.

A class of channel commands are not note specific but can still be used to encode a wide variety of printing information. Two useful messages are "Control Change", with a MIDI channel number, controller ID number (0–97), and a controller value (0–127), and "Channel Pressure", with MIDI channel number (0–15) and a pressure value (0–127) which reflects the mount of pressure applied to all keys. In particular, the Control Change command allows inclusion of a standard MIDI controller number. However, a significant number of these numbers remain undefined in the basic MIDI standard. At least as late as 1989, MIDI controller numbers 20–31 and 70–79 were undefined. Since there are expected to be no MIDI devices which will interpret an "undefined" controller number. In addition, the standard Control Change command is coupled with a one-byte controller value, which can take any value from 0–127. Thus, this instruction alone provides a large number of bits which may be used for a variety of encoding.

The present invention contemplates encoding a wide variety of printing information. Note-specific information includes enharmonic spelling and slurs, discussed above, in addition to stem direction (up/down). In addition, a large number of printing characters do not need to coincide exactly with the beginning of a note and therefore can be encoded using one or more of the several MIDI messages described above. Useful printing characters include crescendo and decrescendo marks, sometimes called "hairpins" or "wedges"), first and second endings, octave transposition (up or down), pedal (on/off), dynamic markings or text, such as "cresc" or piu forte, as well as general tempo markings "Andante, rit., or many others. By way of example, the Polyphonic Key Pressure can be encoded by substituting an "op code" in place of the key number, then using the value byte to modify or pass a parameter to the op code. If a Polyphonic Key Pressure message is provided together with a key number but that key is not currently on, the MIDI message will have no meaning to a performance device or a traditional MIDI process.

In general, it would be preferable to select op codes with very high or very low binary values, corresponding to very high or very low notes on a piano keyboard, further minimizing potential conflicts when using an encoded file with a MIDI system which does not interpret the encoding. Such an encoding scheme could use the following pattern:

| "Key" Number or Op Code | Value |
|---|---|
| Dynamic marking (= 01) | pppp, ppp, . . . mf, f, ff, . . . sfz . . . (= 1, 2, 3, . . . ) |
| Hairpin or Wedge (= 02) | Start hairpin, stop hairpin vertical position relative to a reference music staff, size (vertical extent), duration (= 1, 2, 3, . . . ) |
| Musical Words (= 03) | Crescendo, piu forte, allegro, andante, ritard, rallentando, etc. (= 1, 2, 3, . . . ) |
| Transpose by Octave (= 04) | 8va, 16va (up/down) (= 1, 2, 3, . . . or use bits as flags, e.g. $LSB_0$ = 8va v. 16va, $LSB_1$ = up v. down, etc.) |
| "Direction" Markings (= 7F) | First ending, second ending, repeat, da cappo, fine, etc. (= 1, 2, 3, . . . ) |

One skilled in the art will recognize other possible encoding schemes. For example, a selected bit in a selected MIDI instruction can be used as a flag. When this or some appropriate combination of bits is set, the system will interpret this as a command to go to another location and retrieve encoding information there.

There are some very sophisticated notation schemes for encoding printing information, such as the "SCORE" program, but the bulk of music processing programs are designed to accept and use MIDI.

A general description of the device and method of using the present invention as well as a preferred embodiment of the present invention has been set forth above. One skilled in the art will recognize and be able to practice many changes in many aspects of the device and method described above, including variations which fall within the teachings of this invention. The spirit and scope of the invention should be limited only as set forth in the claims which follow.

What is claimed is:

1. A method of encoding parametric musical printing information in a MIDI message where a digital message representing a MIDI parameter of a selected note is encoded with a binary code by substituting selected bits of said digital message with said binary code, said method comprising:

selecting at least one musical parameter related to music printing, said parameter capable of being described by a finite, integral number of states;

defining said binary code for each said state of said at least one musical parameter; and, selecting said MIDI parameter from one of a note-on velocity parameter, a note-off velocity parameter, a polyphonic key pressure parameter, a channel pressure parameter or a control change parameter, said MIDI parameter not otherwise used for communicating information about said at least one musical parameter, said selected bits of said digital message being selected from one of a representation of least significant bits or a representation of undefined bits of said selected MIDI parameter for said note.

2. The method of claim 1 wherein said at least one musical parameter related to music printing is an enharmonic spelling of said note.

3. The method of claim 2 wherein said selected MIDI parameter is said note-on velocity parameter.

4. The method of claim 2 wherein said selected MIDI parameter is said note-off velocity parameter.

5. The method of claim 3 wherein said binary code is defined as a two bit code encoded in bits representing two least significant bits of said digital message representing said note-on velocity parameter for said note.

6. The method of claim 4 wherein said binary code is defined as a two bit code encoded in bits representing two bits of said digital message representing said note-off velocity parameter for said note.

7. The method of claim 1 wherein said at least one musical parameter related to music printing is selected from the group consisting of slur information, stem direction information, enharmonic spelling, dynamic marking, crescendo and decrescendo, musical text directions, transposition by octave, and direction markings.

* * * * *